US011802570B2

(12) United States Patent
Hadden

(10) Patent No.: US 11,802,570 B2
(45) Date of Patent: Oct. 31, 2023

(54) CEILING FIXTURE COVER

(71) Applicant: Shon L Hadden, Bourbon, IN (US)

(72) Inventor: Shon L Hadden, Bourbon, IN (US)

( * ) Notice: Subject to any disclaimer, the term of this patent is extended or adjusted under 35 U.S.C. 154(b) by 228 days.

(21) Appl. No.: 16/700,035

(22) Filed: Dec. 2, 2019

(65) Prior Publication Data

US 2020/0173447 A1 Jun. 4, 2020

Related U.S. Application Data

(60) Provisional application No. 62/773,282, filed on Nov. 30, 2018.

(51) Int. Cl.
*F04D 25/08* (2006.01)
*F04D 29/00* (2006.01)

(52) U.S. Cl.
CPC ..... *F04D 25/088* (2013.01); *F04D 29/005* (2013.01)

(58) Field of Classification Search
CPC ..... F04D 25/088; F04D 29/005
USPC ..... 416/62, 247 R; 150/154, 157, 158, 168
See application file for complete search history.

(56) References Cited

U.S. PATENT DOCUMENTS

| | | | | |
|---|---|---|---|---|
| 5,281,093 | A | 1/1994 | Sedlak et al. | |
| 8,100,652 | B2 * | 1/2012 | Bauer | F04D 25/088 416/247 R |
| 8,342,806 | B1 * | 1/2013 | Stabe, Jr. | F04D 29/703 416/146 R |
| 2003/0226846 | A1 * | 12/2003 | Horwath | B65F 1/16 220/287 |
| 2011/0305571 | A1 * | 12/2011 | Heim | F04D 25/088 416/62 |

* cited by examiner

*Primary Examiner* — Charles G Freay
*Assistant Examiner* — Lilya Pekarskaya
(74) *Attorney, Agent, or Firm* — Taylor IP, P.C.

(57) ABSTRACT

A cover for a ceiling fixture including a top piece having an outer edge, a bottom piece having an outer edge, first and second linear coupling arrangements. The outer edges of the top and bottom pieces being joined together. An opening extending from a beginning point at a location on the top piece through a middle of the top piece outwardly toward a point along the outer edge of the top piece opposite the beginning point to an ending point on the bottom piece. The first linear coupling arrangement being coupled to the top piece and the bottom piece along the opening from the ending point of the opening toward the middle of the top piece. The second linear coupling arrangement being coupled to the top piece along the opening extending from the beginning point through the middle of the top piece toward the first linear coupling arrangement.

18 Claims, 3 Drawing Sheets

CEILING FIXTURE COVER

CROSS REFERENCE TO RELATED APPLICATIONS

This is a non-provisional application based upon U.S. provisional patent application Ser. No. 62/773,282, entitled "CEILING FIXTURE COVER", filed Nov. 30, 2018, which is incorporated herein by reference.

BACKGROUND OF THE INVENTION

1. Field of the Invention

The present invention relates to fixture covers, and, more particularly, to ceiling fixture covers that can be used to protect ceiling fixtures.

2. Description of the Related Art

Ceiling fixtures provide lighting and for air movement in a room, with ceiling fans being popular for circulating air within a room. Ceiling fans are now often used in outdoor applications, such as on covered porches or patios.

Covers, such as sheets of plastic or drop cloths are often used to cover ceiling fixtures when painting or construction is to take place to protect the fixtures from dust and paint. Such sheets or tarps provide issues in that they are typically rectangular and are ill fitted to cover ceiling fixtures which often have some axial symmetry about a vertical axis. Further, some covers are heavy, and in the case of fans the blades are not typically designed to handle much weight. Still further typical rectangular covers will hang down and may be snagged by workers or equipment and cause damage to the fixture. Yet further covers that are applied over the top of fixtures are often open on the bottom allowing air currents to carry paint or dust to the fixtures.

Many patents disclose a ceiling fan cover that protects the blades of ceiling fans, such as U.S. Pat. No. 5,281,093, issued to Sedlak, et al., which disclose fan blade covers with a zipper along part of the length of the blade. Sedlak, however, does not protect the fan's housing and motor. U.S. Pat. No. 8,100,652, issued to Bauer et al., disclose a ceiling fan cover for protecting a ceiling fan while the ceiling fan is not in use. The cover is made of a semi-waterproof, vinyl material that encloses an indoor or outdoor ceiling fan. The cover also includes a zipper, to close the cover around the ceiling fan's blades and a drawstring to tighten up the cover around the top of the fan. The cover could have an additional drawstring to cinch the middle (Abstract of Bauer et al.).

What is needed in the art is an easy to apply fixture cover that conforms to various shapes of fans for a compact efficient cover of the fixture.

SUMMARY OF THE INVENTION

The present invention provides a ceiling fixture cover.

The invention in one form is directed to a cover for a ceiling fixture including a top piece having an outer edge, a bottom piece having an outer edge, first and second linear coupling arrangements. The outer edges of the top and bottom pieces being joined together. An opening extending from a beginning point at a location on the top piece through a middle of the top piece outwardly toward a point along the outer edge of the top piece opposite the beginning point to an ending point on the bottom piece. The first linear coupling arrangement being coupled to the top piece and the bottom piece along the opening from the ending point of the opening toward the middle of the top piece. The second linear coupling arrangement being coupled to the top piece along the opening extending from the beginning point through the middle of the top piece toward the first linear coupling arrangement.

The invention in another form is directed to a method of covering a ceiling fixture, the method including the steps of moving a cover, coupling a first linear coupling arrangement, and coupling a second linear coupling. The moving a cover step includes moving the cover around the ceiling fixture using an opening in the cover. The cover has a top piece with an outer edge, and a bottom piece having an outer edge, the outer edge of the bottom piece being joined to the outer edge of the top piece. The coupling a first linear coupling arrangement includes coupling the first linear coupling arrangement in the cover to itself. The coupling a second linear coupling arrangement includes coupling the second linear coupling arrangement in the cover to itself. The opening extends from a beginning point at a location of the top piece through a middle of the top piece outwardly toward a point along the outer edge of the top piece opposite the beginning point to an ending point located on the bottom piece. The first linear coupling arrangement is coupled to the top piece and the bottom piece along the opening from the ending point of the opening toward the middle of the top piece. The second linear coupling arrangement is coupled to the top piece along the opening, the second linear coupling arrangement extending from the beginning point through the middle of the top piece toward the first linear coupling arrangement.

An advantage of the present invention is that an effective cover for ceiling fixtures is achieved.

Another advantage is the varying closing types along the opening allow for conforming the cover around the portion of the fixture coupled to the ceiling.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
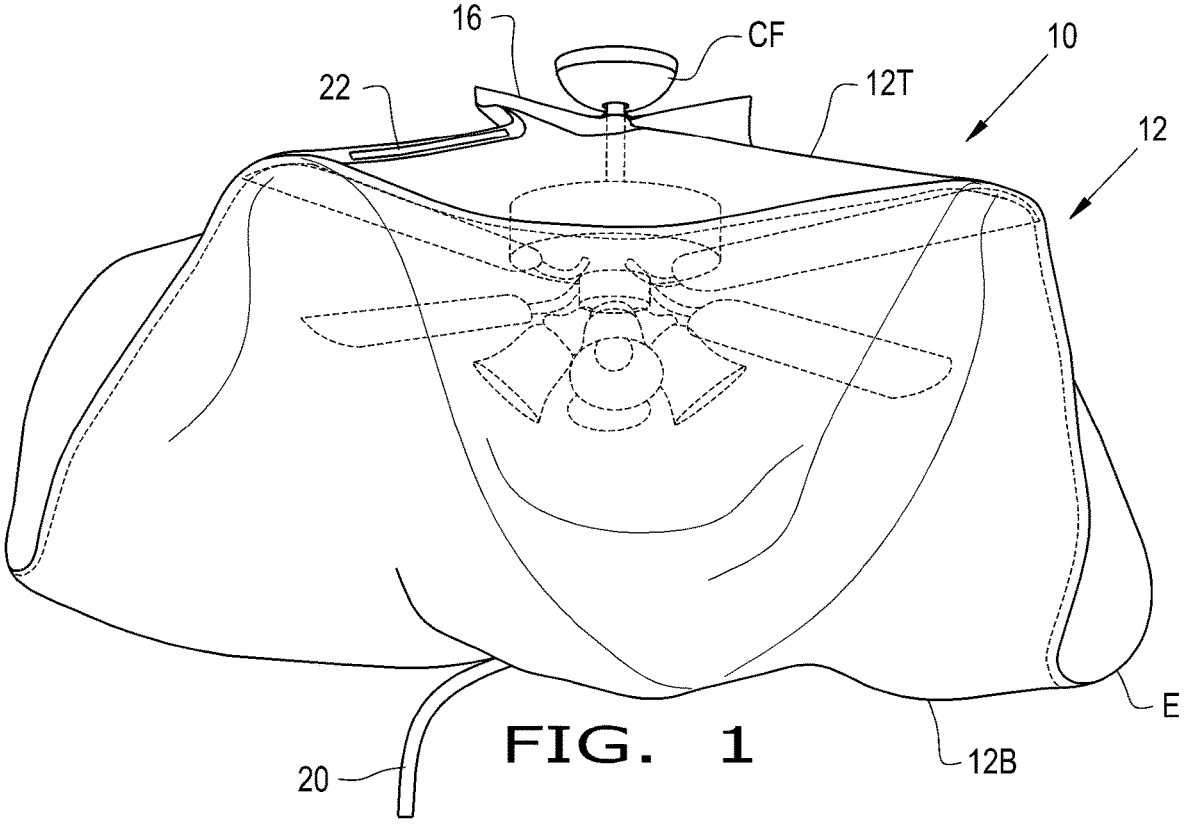
FIG. 1 is a perspective view of an embodiment of a ceiling fixture cover of the present invention covering a ceiling fixture, in the form of a ceiling fan.
Figure 2:
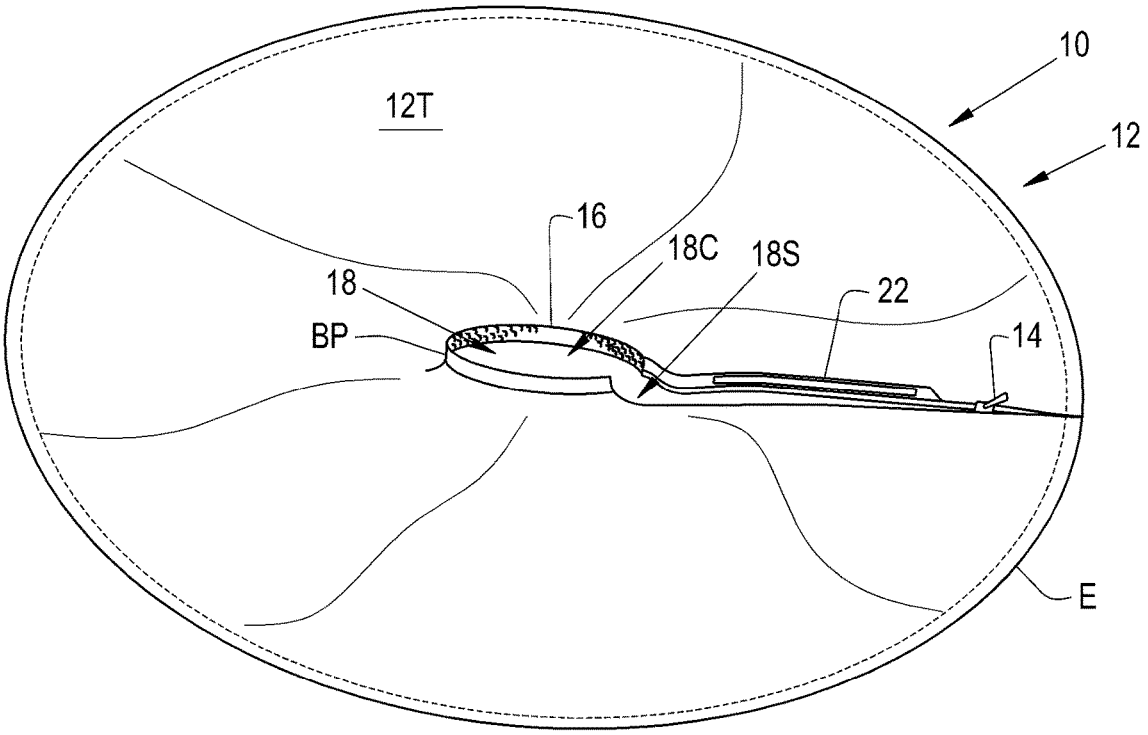
FIG. 2 is a perspective view of the cover of FIG. 1 shown uninstalled essentially laying flat.
Figure 3:
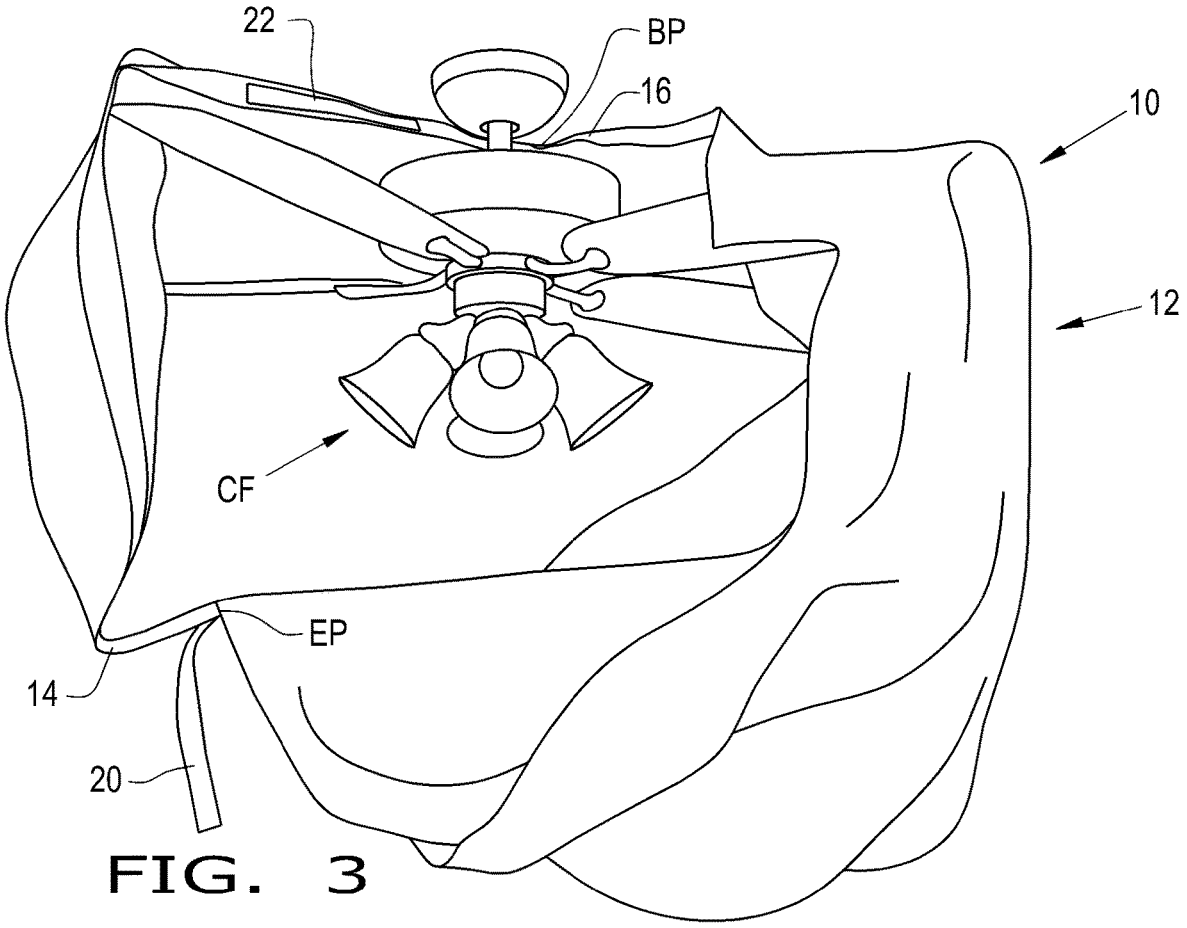
FIG. 3 is a perspective view of the cover of FIGS. 1 and 2 being installed over a ceiling fan.
Figure 4:
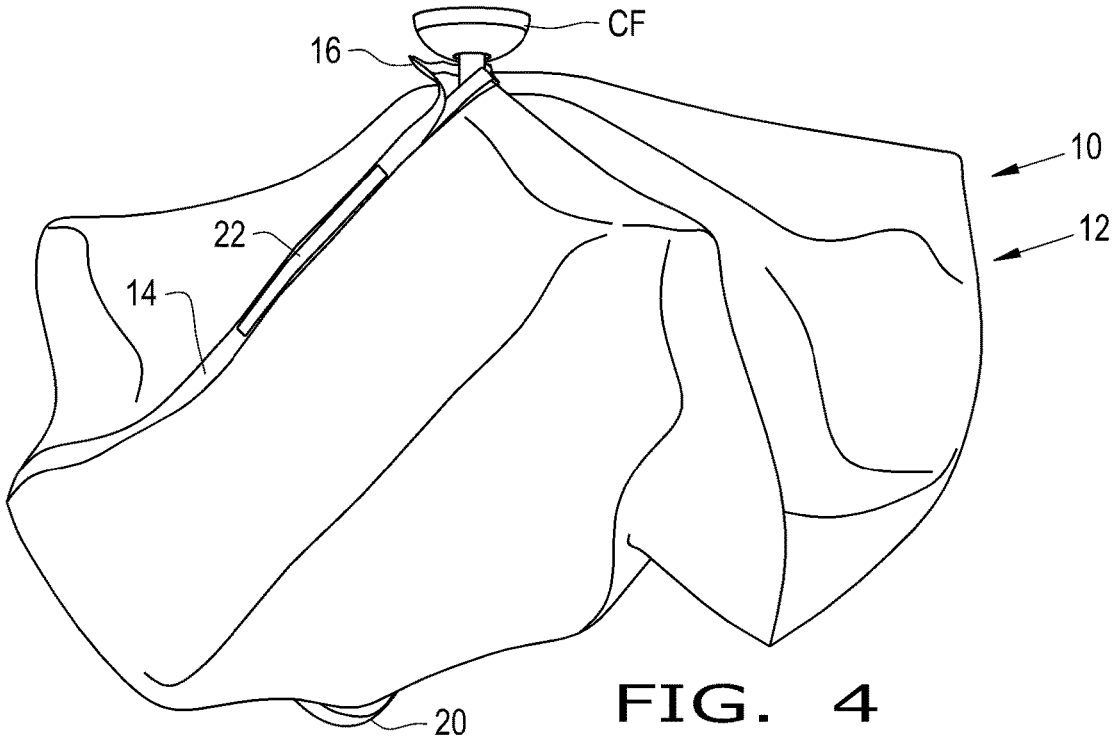
FIG. 4 illustrates the cover of FIGS. 1-3 being substantially closed around the ceiling fan.

Referring now to the drawings, and more particularly to FIG. 1-6, there is shown a ceiling fixture cover 10, which can also be understood to be a Ceiling Fan/Chandelier Cover/Protector. Cover 10 is made of a material that is water, paint, and dust resistant. Cover 10 is reusable, but is inexpensive enough that it can also be disposable.

Cover 10 includes a top cover member 12T, a bottom cover member 12B, a side closure arrangement 14, and a central closure arrangement 16. Cover members 12T and 12B, collectively referred to as cover member 12, is a fabric, or membrane that protects an enclosed ceiling fixture CF. Side closure arrangement 14 can be a zipper 14 or a Velcro® arrangement 14 that closes an opening that is approximately half of the width or diameter of member 12 extending across both members 12T and 12B.

Central closure arrangement 16 is located at an end of the side closure arrangement 14, and is configured to close a central opening that is generally located in the overall central portion of cover member 12. Central closure arrangement 16 allows for the coupling of the sides of the central opening to enclose as completely as possible the fixture within member 12. Central closure arrangement 16 is a hook and loop or Velcro® arrangement that couples the sides of closure arrangement 16 to each other.

To put on Ceiling Fan/Chandelier Cover 10, first, you pull apart the Velcro® closure 16 on the collar (central portion of member 12), then unzip zipper 14. Cover member 12 is then opened up, and held open to cover up a ceiling fan CF or a chandelier CF. Typically cover 10 is held with one hand then with the other hand a feeding/spinning of the ceiling fan blade or chandelier/light fixture CF is undertaken to thereby place the fixture into cover 10. As the fixture is feed/spun into cover 10, you then wrap the cover around the blades and ceiling fan motor or chandelier/light fixture until the ceiling fan or chandelier is substantially covered. Then zipper 14 is zipped on cover 10 all the way to the central opening. Then central closure arrangement 16 is used to close the collar using the attached sewn in Velcro® around the ceiling fan motor or rod, or chandelier wires or chain.

To Remove Ceiling Fan/Chandelier Cover 10, you first pull apart Velcro closure 16 on the collar, then you unzip zipper 14. With the openings all gaping, you then pull cover 10 off a few ceiling fan blades or a portion of the chandelier and spin slowly and unwrap the ceiling fan or chandelier/light fixture.

Figure 5:
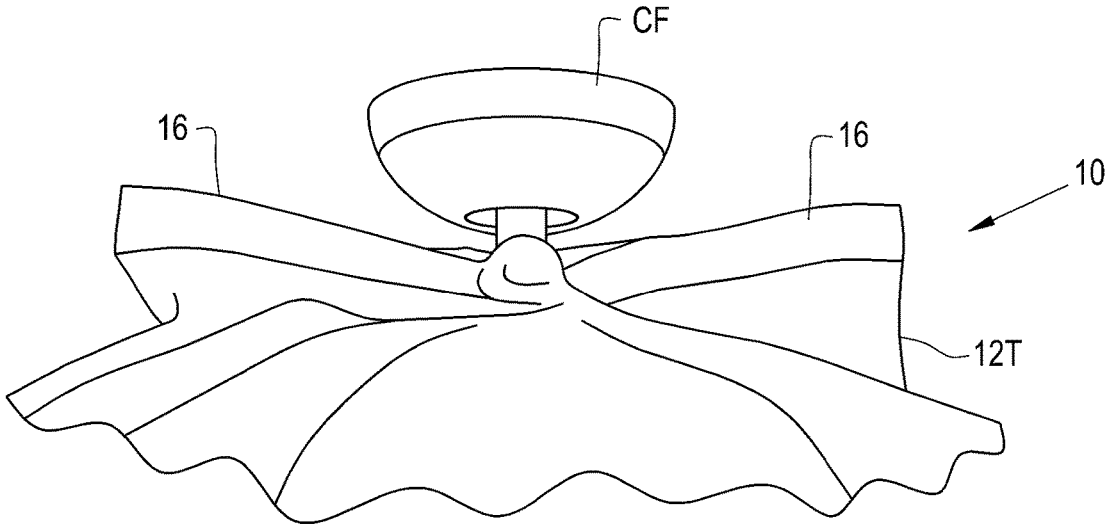
FIG. 5 is a close up of the cover of FIGS. 1-4 illustrating the closure of a top portion of the cover.
Figure 6:
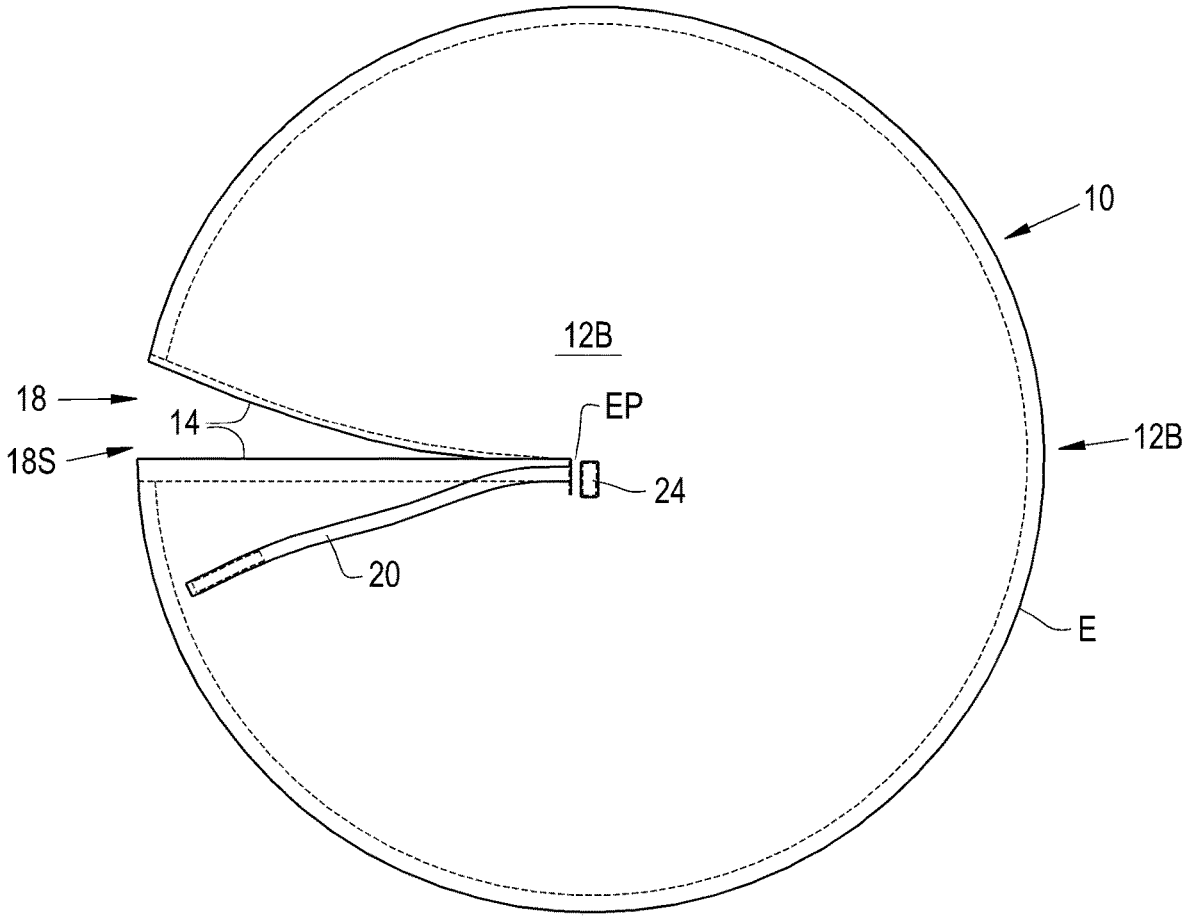
FIG. 6 is a bottom view of the cover of FIGS. 1-5 illustrating a cinch coupling and the extent of the opening of the top and bottom pieces.

Advantageously cover 10 does not use a drawstring, but uses a closure system 16 that allows both sides of the central opening to be coupled together as shown in FIG. 5.

Cover 10 includes top piece 12T having an outer edge E, and bottom piece 12B has an outer edge E. The outer edges E of bottom piece 12B is joined to outer edge E of top piece 12T at a common seam. Cover 10 also includes a first linear coupling arrangement 14 (zipper 14) and a second linear coupling arrangement 16. The phrase linear coupling arrangement means that along the linear length of the arrangement is coupled to member 12 and that it allows for coupling to itself along that length.

Top piece 12T has an opening 18 therein, with opening 18 extending from a beginning point BP at a location of top piece 12T through a middle of top piece 12T outwardly toward a point along outer edge E of top piece 12T opposite beginning point BP to an ending point EP located on bottom piece 12B. The first linear coupling arrangement 14 being coupled along opening 18 from ending point EP of opening 18 toward the middle of top piece 12T. Second linear coupling arrangement 16 is coupled to top piece 12T along opening 18, with second linear coupling arrangement 16 extending from beginning point BP through the middle of top piece 12T toward first linear coupling arrangement 14. It is also contemplated that opening 18 can extend into bottom piece 12B and first linear coupling arrangement 14 would also extend into bottom piece 12B.

Cover 10 also includes a cinch coupling 20 connected to bottom piece 12B, proximate to ending point EP, which may be close to a center portion of bottom piece 12B. Cinch coupling 20 is coupled at a middle portion to bottom piece 12B, so that the unconnected end of cinch coupling 20 can be looped around an installed cover 10 and coupled to a mating strip 22 on top piece 12T so as to cinch up the otherwise hanging bottom portion of cover 10. Cinch coupling 20 and mating strip 22 are collectively a hook and loop arrangement, although other arrangements are also contemplated. Further, a small strip 24 is located on bottom piece 12B that is used to hold cinch coupling 20, until it is needed.

Opening 18 can, along a portion, be a slit 18S, with another part of opening 18 being a central portion 18C, which can be a curved portion 18C, or portion 18C can be a continuation of slit 18S. First linear coupling arrangement 14 is connected to cover member 12 along most of a length of slit 18S. Second linear coupling arrangement 16 is connected to top piece 12T along most of, or all of central portion 18C.

First linear coupling arrangement 14, as discussed above, may be in the form of a zipper 14, and second linear coupling arrangement 16 is in the form of a hook and loop arrangement 16. Cinch coupling 20/strip 22/strip 24 is also in the form of a hook and loop coupling.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cover for a ceiling fixture, comprising:

a top piece having an outer edge;

a bottom piece having an outer edge, the outer edge of the bottom piece being joined to the outer edge of the top piece;

a first linear coupling arrangement;

a second linear coupling arrangement, the top piece and the bottom piece having an opening therein, the opening extending from a beginning point at a location of the top piece through a middle of the top piece outwardly toward a point along the outer edge of the top piece opposite the beginning point to an ending point on the bottom piece, the first linear coupling arrangement being coupled to the top piece and the bottom piece along the opening from the ending point toward the middle of the top piece, the second linear coupling arrangement being coupled to the top piece along the opening, the second linear coupling arrangement extending from the beginning point through the middle of the top piece toward the first linear coupling, arrangement;

a cinch coupling having a first end and a second end, the first end of the cinch coupling being attached to the bottom piece at the ending point;

a small strip arranged to hold the cinch coupling, the small strip being located on the bottom piece; and a mating strip on the top piece to which the second end of the cinch coupling is connected to cinch up the bottom piece.

2. The cover of claim 1, wherein the cinch coupling is connected to a center portion of the bottom piece.

3. The cover of claim 1, wherein at least a part of the opening is a slit.

4. The cover of claim 3, wherein an other part of the opening is a curved portion.

5. The cover of claim 3, wherein the first linear coupling arrangement is connected to the top piece and the bottom piece along most of a length of the slit.

6. The cover of claim 5, wherein the second linear coupling arrangement is connected to a central portion of the top piece along the opening.

7. The cover of claim 6, wherein the cinch coupling is connected to a center portion of the bottom piece, the cinch coupling being configured to be looped around the cover and the second end of the cinch coupling being connected to the mating strip.

8. The cover of claim 7, wherein the small strip on the bottom piece, the small strip being proximate the ending point, the cinch coupling being connectable to the small strip.

9. The cover of claim 1, wherein the first linear coupling arrangement is a zipper, the second linear coupling arrangement being a hook and loop arrangement.

10. A method of covering a ceiling fixture, the method comprising the steps of:

moving a cover around the ceiling fixture using an opening in the cover, the cover having a top piece with an outer edge, the cover also having a bottom piece having an outer edge, the outer edge of the bottom piece being joined to the outer edge of the top piece;

coupling a first linear coupling arrangement in the cover to itself; and coupling a second linear coupling arrangement in the cover to itself, the opening extending from a beginning point at a location of the top piece through a middle of the top piece outwardly toward a point along the outer edge of the top piece opposite the beginning point to an ending point located on the bottom piece, the first linear coupling arrangement being coupled to the top piece and the bottom piece along the opening from the ending point toward the middle of the top piece, the second linear coupling arrangement being coupled to the top piece along the opening, the second linear coupling arrangement extending from the beginning point through the middle of the top piece toward the first linear coupling arrangement, the cover additionally including:

a cinch coupling having a first end and a second end, the first end of the cinch coupling being attached to the bottom piece at the ending point;

a small strip arranged to hold the cinch coupling, the small strip being located on the bottom piece; and a mating strip on the top piece to which the second end of the cinch coupling is connected to cinch up the bottom piece.

11. The method of claim 10, wherein the cinch coupling is connected to a center portion of the bottom piece.

12. The method of claim 10, wherein at least a part of the opening is a slit.

13. The method of claim 12, wherein an other part of the opening is a curved portion.

14. The method of claim 12, wherein the first linear coupling arrangement is connected to the top piece and the bottom piece along most of a length of the slit.

15. The method of claim 14, wherein the second linear coupling arrangement is connected to a central portion of the top piece along the opening.

16. The method of claim 15, wherein the cinch coupling connected to a center portion of the bottom piece, the cinch coupling being configured to be looped around the cover and the second end of the cinch coupling being connected to the mating strip.

17. The method of claim 16, wherein the small strip on the bottom piece, the small strip being proximate the ending point, the cinch coupling being connectable to the small strip.

18. The method of claim 10, wherein the first linear coupling arrangement is a zipper, the second linear coupling arrangement being a hook and loop arrangement.

* * * * *